United States Patent [19]

Eichman et al.

[11] Patent Number: 4,700,554

[45] Date of Patent: Oct. 20, 1987

[54] DETERGENT DISPENSER WITH IMPROVED WATER DISTRIBUTION MEANS

[75] Inventors: Carl E. Eichman, Lincoln Township, Berrien County; Vincent P. Gurubatham, St. Joseph Township, Berrien County; Dennis W. Hauch, Baroda Township, Berrien County; Garrett K. Kinyon, Watervliet Township, Berrien County, all of Mich.

[73] Assignee: Whirlpool Corporation, Benton Harbor, Mich.

[21] Appl. No.: 830,845

[22] Filed: Feb. 19, 1986

[51] Int. Cl.[4] ..... D06F 39/02

[52] U.S. Cl. ..... 68/17 R; 137/268; 422/264; 422/266

[58] Field of Search ..... 68/17 R; 134/93, 100; 137/268; 422/264, 266, 277; 366/181

[56] References Cited

U.S. PATENT DOCUMENTS

| | | | |
|---|---|---|---|
| 1,975,749 | 10/1934 | Lang | 422/266 |
| 2,601,672 | 6/1952 | Gatchet | 422/266 X |
| 3,127,067 | 3/1964 | Hall et al. | 68/17 R X |
| 3,248,910 | 5/1966 | Bochan | 68/17 R X |
| 3,258,792 | 7/1966 | Rickel | 68/17 R X |
| 3,479,845 | 11/1969 | Engebretsen | 68/17 R |
| 3,696,970 | 10/1972 | Bunnell et al. | 68/17 R X |
| 3,757,543 | 9/1973 | Braga | 68/17 R |
| 3,760,612 | 9/1973 | Bochan et al. | 68/17 R |
| 3,805,562 | 4/1974 | Waugh et al. | 68/17 R |
| 3,942,341 | 3/1976 | Sang | 68/17 R |
| 3,974,667 | 8/1976 | Gakhar | 68/17 R |
| 3,975,931 | 8/1976 | Bischkopf | 68/17 R |
| 3,990,272 | 11/1976 | Gakhar | 68/17 R |
| 4,110,075 | 8/1978 | Graf et al. | 68/17 R |
| 4,160,367 | 7/1979 | Vona, Jr. | 68/17 R |
| 4,203,307 | 5/1980 | Obata et al. | 137/268 X |
| 4,429,817 | 2/1984 | Ikeda | 68/17 R X |
| 4,467,627 | 8/1984 | Platt et al. | 68/17 R |

FOREIGN PATENT DOCUMENTS

| | | | |
|---|---|---|---|
| 1913591 | 8/1969 | Fed. Rep. of Germany | 134/93 |
| 1289412 | 9/1972 | United Kingdom | 68/17 R |

*Primary Examiner*—Philip R. Coe

*Attorney, Agent, or Firm*—Hill, Van Santen, Steadman & Simpson

[57] ABSTRACT

A dispenser for a granular wash additive is provided which comprises a reservoir for receiving the additive and has a liquid inlet and a narrow slot-like opening for dispensing the additive. A tunnel member or chute is provided in the liquid flow path between the inlet and outlet, which is to be covered by the additive so that a portion of the inlet liquid will be directed below and within the pile of additive to effect a complete dispensing of the additive. An insert is provided for dispensing liquid additive from the same dispenser.

14 Claims, 14 Drawing Figures

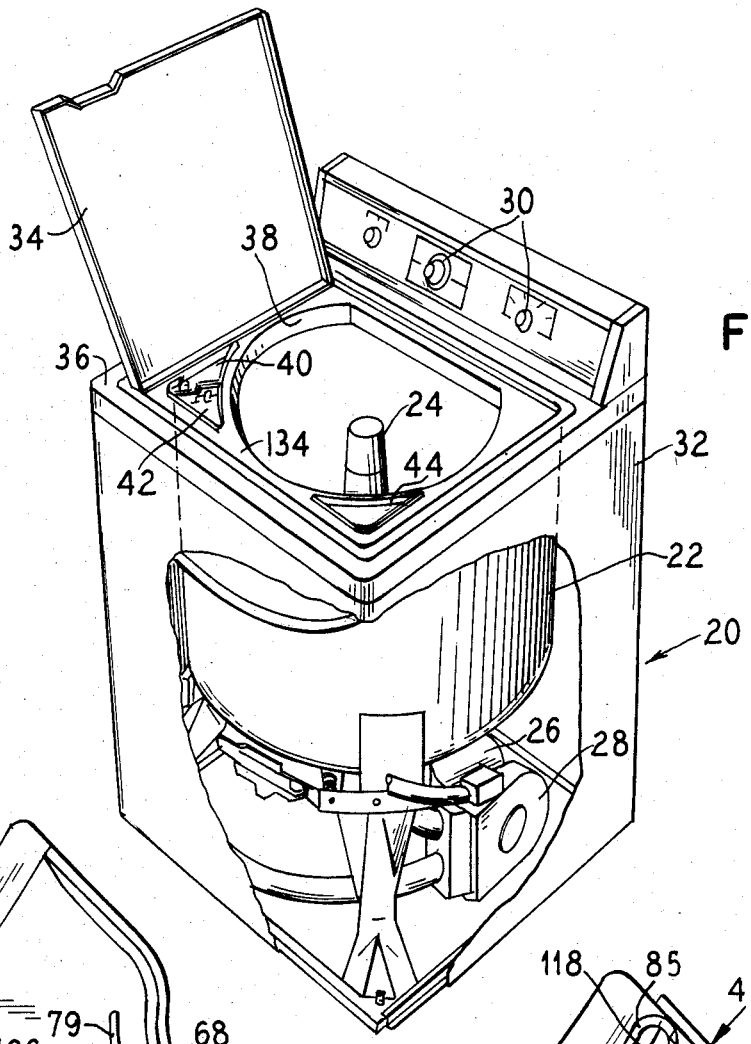
FIG. 1
FIG. 5
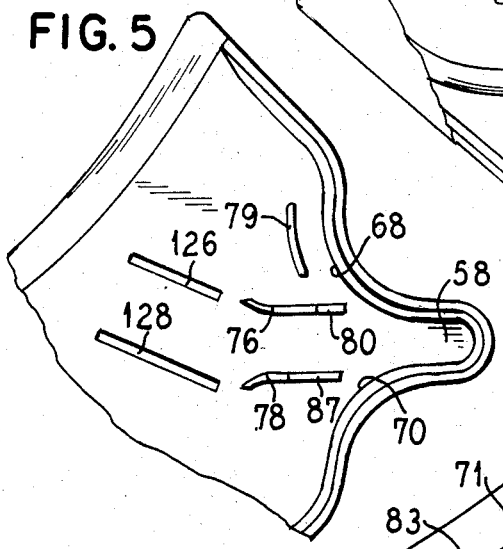
FIG. 4
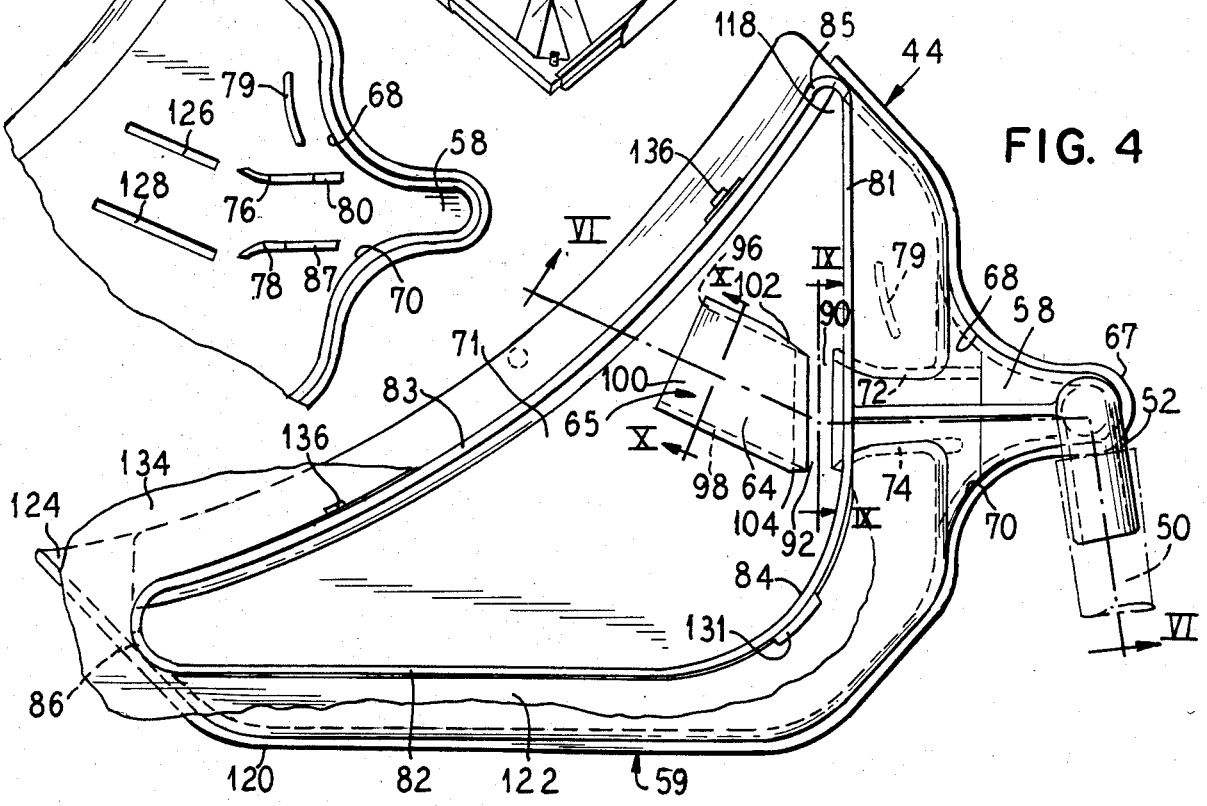

FIG. 11
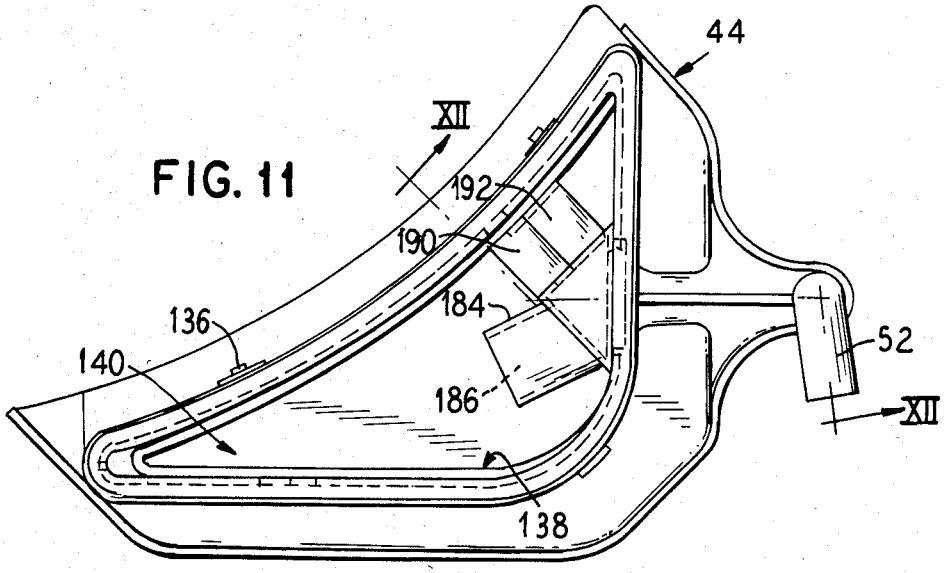
FIG. 12
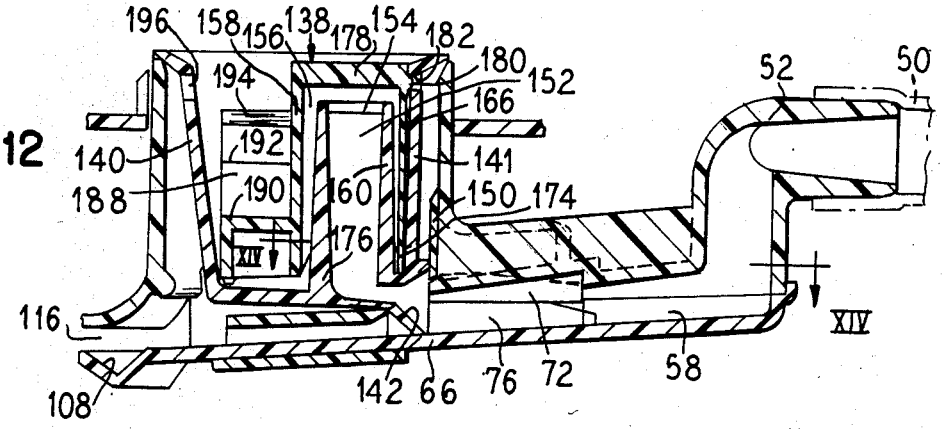
FIG. 13
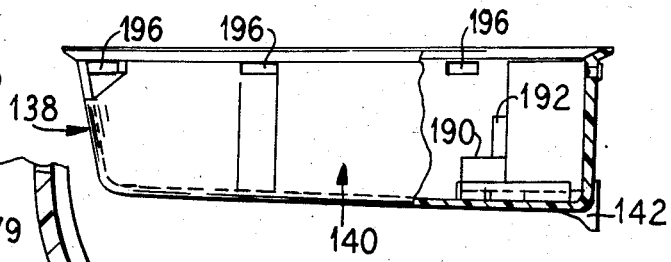
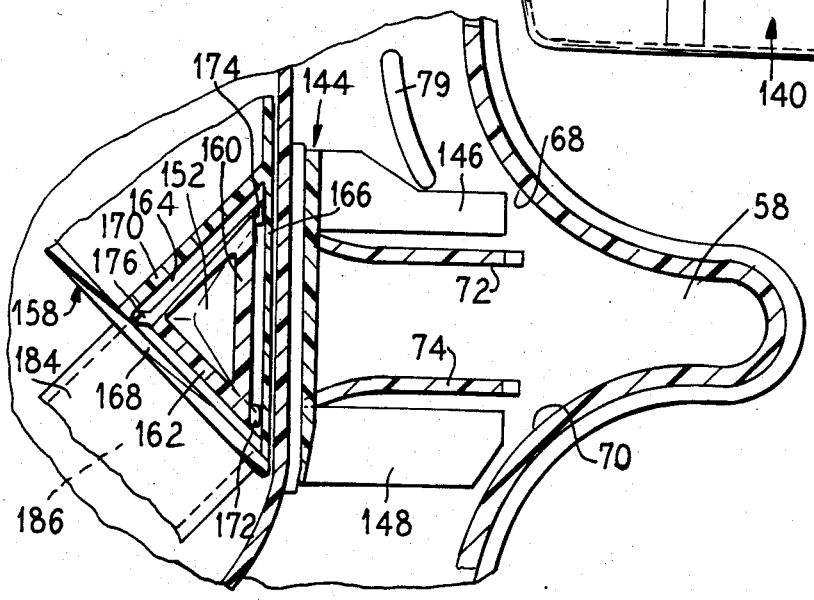
FIG. 14

DETERGENT DISPENSER WITH IMPROVED WATER DISTRIBUTION MEANS

BACKGROUND OF THE INVENTION

1. Field of the Invention

The present invention relates to an improvement for an automatic washer detergent dispenser which washes a granular detergent into the wash bath automatically as an incident of water being supplied to the dispenser assembly and which includes a separate vessel that can be inserted for dispensing liquid detergent.

2. Description of the Prior Art

Complete dispensing of granular detergent can sometimes be difficult to achieve. This is particularly true when cold water is used for the washing and dispensing process. Depending on the geometry of the dispenser reservoir and water inlet arrangement, some of the detergent may float on top of the water stream and be prevented from escaping from the dispenser. In some cases, introduction of the water may cause large clumps of detergent to form which are too large to pass through the dispenser outlet. It has also been found that a substantial quantity of the detergent is sometimes simply pushed to another region of the dispenser reservoir where it remains as water flows around the mass of detergent to unblocked portion of the dispenser outlet. These problems are most likely to arise in dispensers having narrow, slotlike outlets, which is a desirable outlet configuration. U.S. Pat. No. 3,696,970 discloses a multiple compartment dispenser that includes a central reservoir for dispensing granular detergent. Detergent is flushed from the compartment by means of a water stream that is supplied to the lower side wall of the compartment as shown in detail in FIG. 3.

U.S. Pat. No. 3,757,543 discloses a granular detergent dispenser that is incorporated in a manual lint filter within the water recirculation path of an automatic washer. The dispenser includes a selectively movable detergent tray, from which the detergent is washed by the recirculating water stream. The water stream simply sweeps through the detergent tray.

SUMMARY OF THE INVENTION

It is an object of the present invention to provide an improved detergent dispenser structure that provides for complete dispensing of a granular detergent. The dispenser can also be used to dispense liquid detergents through the use of a separate insert. It is a more specific object of the invention to provide an improved water inlet arrangement that delivers the water to the dispenser in a manner that helps ensure complete dispensing.

The dispenser consists of a detergent reservoir that is mounted to the top wall of the automatic washer cabinet, adjacent to the tub opening. The dispenser is covered by the washer lid when the lid is closed. Water to effect dispensing of the detergent is selectively supplied to the dispenser from an external source, as is conventional. This source can be a supply of fresh water, as in the preferred embodiment, or a source of recirculated water supplied by means of a pump. The dispensing reservoir has a long, horizontal slot-like outlet that discharges the water and detergent mixture into the wash bath.

A primary feature of interest in the structure is the water inlet means. In particular, the dispenser includes means for delivering a substantial portion of the inlet water to a tunnel-like member or chute which delivers the water to a point beneath the pile of granular detergent. It should, however, be noted that some of the incoming water is also delivered to the sides of the detergent pile. Further, there is a gap between the entrance to the tunnel and the point at which the incoming water is discharged into the reservoir, thus permitting some of the incoming water to flow over and around the tunnel.

This water inlet structure has been found to be highly effective in overcoming the above-identified problems that can result in incomplete detergent dispensing. It should be noted that it is desirable to provide a long, narrow dispenser outlet opening, as opposed to a large rectangular opening, so as to distribute the water/detergent mixture broadly as it enters the wash load and to prevent a large clump or mass of detergent from being discharged into the wash load.

A detergent dispenser constructed according to the principles of the present invention has the advantages that it provides a complete dispensing of granular detergent, regardless of water temperature used; it can be used in conventional automatic washers, with conventional water delivery means; and the structure of the dispenser itself is simple, and can be manufactured inexpensively. The dispenser structure is unique in that it delivers a portion of the dispenser inlet water to a region located beneath mass of the detergent unlike any dispensers disclosed in the prior art and in that it uses a partial tunnel, or other enclosure, to deliver the inlet water to the region located beneath the mass of detergent.

BRIEF DESCRIPTION OF THE DRAWINGS

FIG. 1 is a perspective view of an automatic washer embodying the principles of the present invention.

FIG. 4 is a plan view of the detergent dispenser embodying the principles of the present invention.

FIG. 5 is a partial plan view of the bottom portion of the detergent dispenser shown in FIG. 4.

FIG. 11 is a plan view of the detergent dispenser with a liquid dispenser insert.

FIG. 12 is a side sectional view of the detergent dispenser with the liquid dispenser attachment taken generally along the line XII—XII of FIG. 11.

FIG. 13 is a side elevational view, partially cut away, of the liquid dispenser insert.

FIG. 14 is a top sectional view of the detergent dispenser with liquid dispenser insert taken generally along the line XIV—XIV of FIG. 12.

DESCRIPTION OF THE PREFERRED EMBODIMENT

Figure 2:
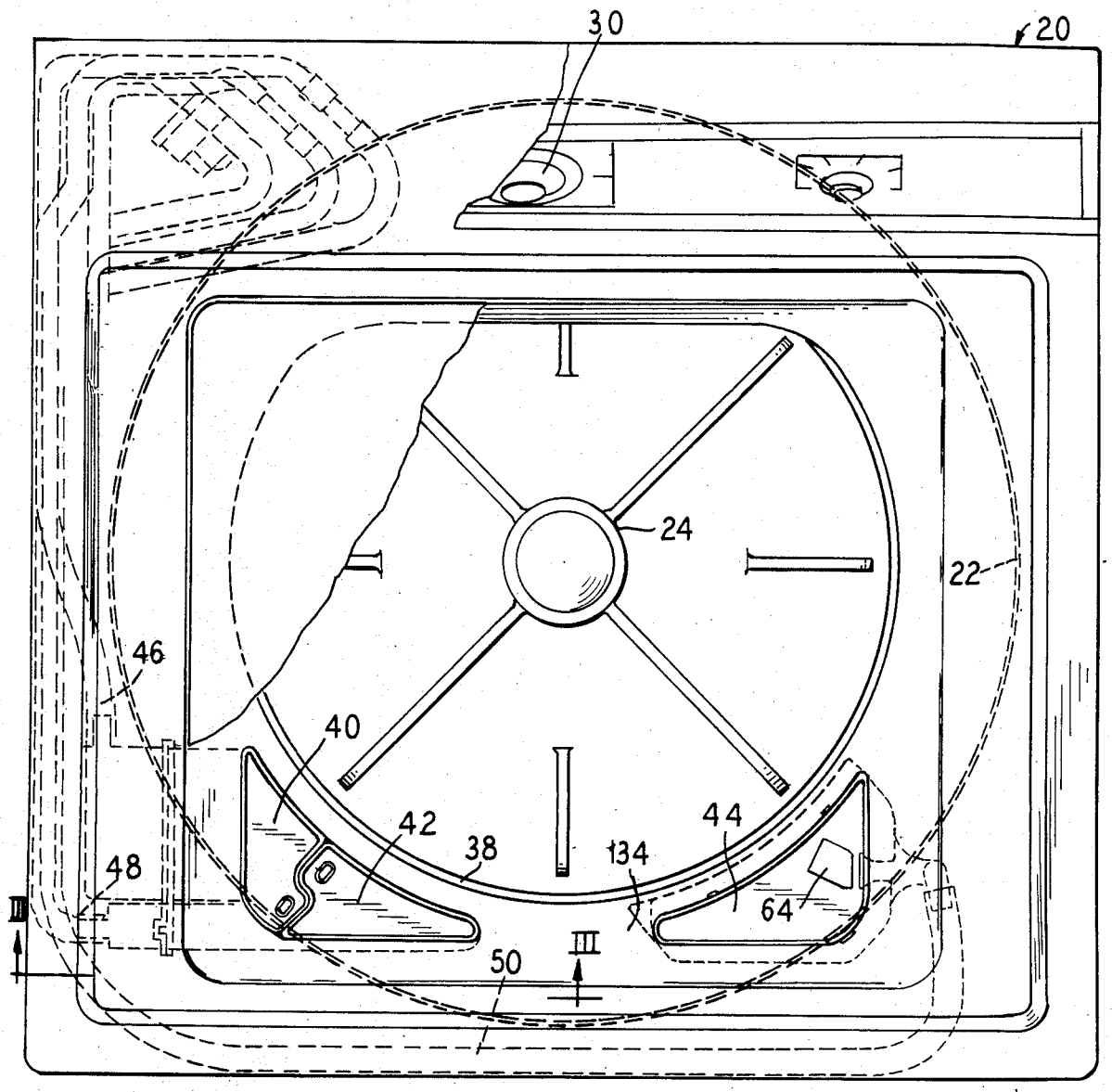
FIG. 2 is a plan view, partially cut away of the automatic washer of FIG. 1.

In FIG. 1 a washing machine is generally shown at 20 as having a wash tub 22 with a vertical agitator 24 therein, a water supply (not visible), an electrically driven motor 26 operating a pump 28 and controls 30 including a pre-settable sequential control means for use in selectively operating the washing machine 10 through a programmed sequence of washing, rinsing and drying steps.

Figure 3:
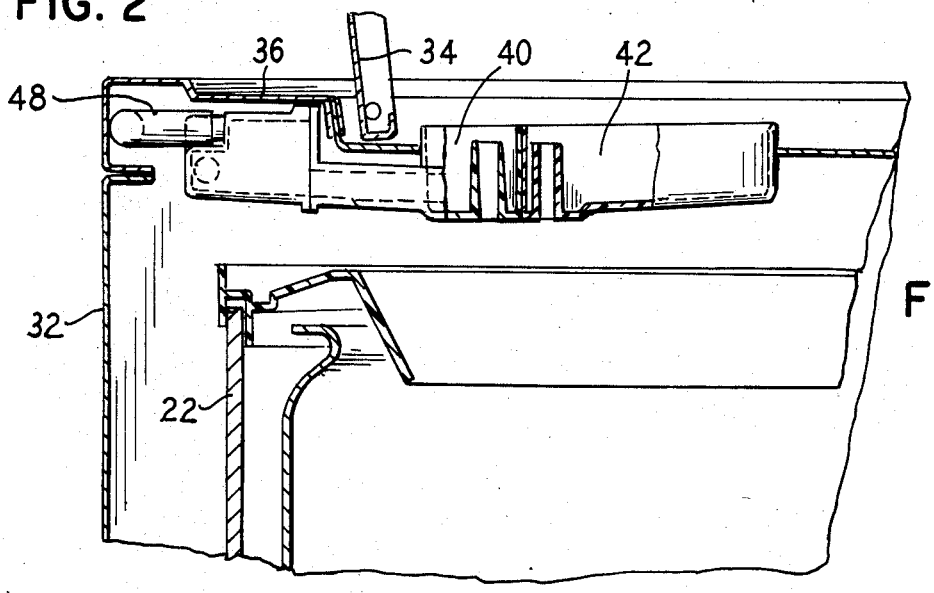
FIG. 3 is a partial sectional view of the interior of the washer of FIG. 1 taken generally along the lines III—III of FIG. 2.

The washer 20 has an outer cabinet 32 with an openable lid 34 hinged to a top panel 36 of the cabinet 32. Surrounding a top opening 38 above the tub 22, just below the openable lid 34 are a plurality of wash additive dispensers 40, 42 and 44. As seen in FIGS. 1, 2 and 3, these dispensers are accessible when the hinged lid 34 is in an open position. Dispensers 40 and 42 can be used for dispensing additives such as bleach or fabric softeners and dispenser 44 can be used to dispense detergent into the wash load at the appropriate time in the automatic wash cycle. Each of the dispensers, 40 42, 44 are supplied with liquid through a separate, dedicated conduit 46, 48, 50 respectively. Each of the conduits 46, 48, 50 may be connected to a fluid source in a conventional manner, as by respective solenoid operated valves (not shown) which connect each conduit to the household water supply. The dispensers 40 and 42, which are designed to receive liquid additives, can use a well known siphon system to dispense the additives into the wash tub 22.

The detergent dispenser 44 represents an improvement over known detergent dispensers, particularly granular detergent dispensers, and its structural arrangement is shown in greater detail in FIGS. 4–10.

Figure 7:
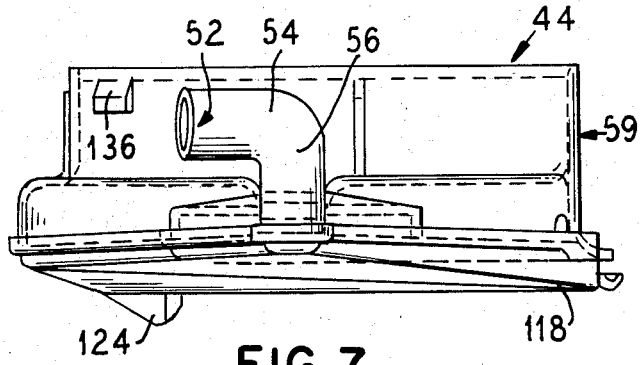
FIG. 7 is an end elevational view of the detergent dispenser.
Figure 10:
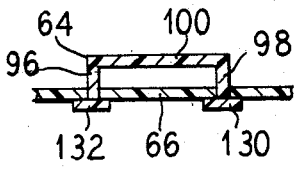
FIG. 10 is a sectional view of the tunnel portion of the dispenser taken generally along the line X—X of FIG. 4.
Figure 8:
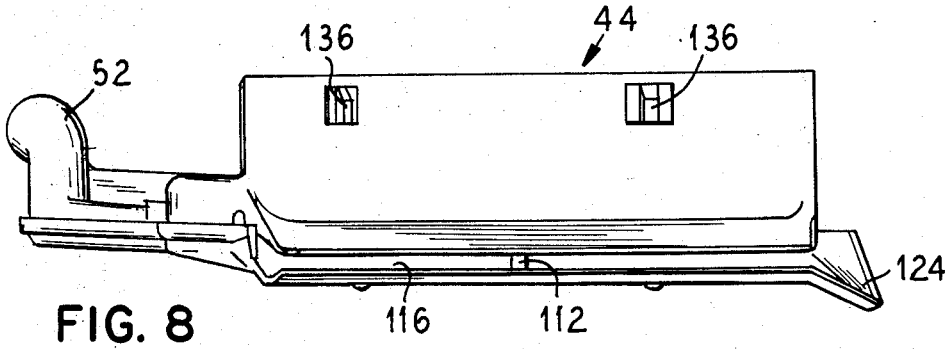
FIG. 8 is a front elevational view of the detergent dispenser.
Figure 9:
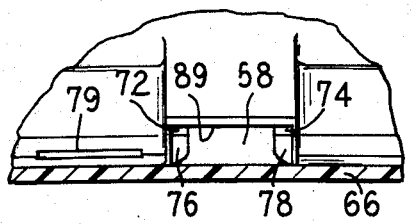
FIG. 9 is an end elevational view of the inlet passage of the detergent dispenser taken generally along the line IX—IX of FIG. 4.

FIG. 4 is a plan view of the dispenser 44 having an inlet tube 52 to which is attached the liquid inlet conduit 50. As best seen in FIG. 7, the inlet tube 52 comprises a first horizontal portion 54 and a connected vertical portion 56. The vertical portion 56 communicates at a bottom end with an expanding passage 58 (FIG. 4) formed in the dispenser.

Figure 6:
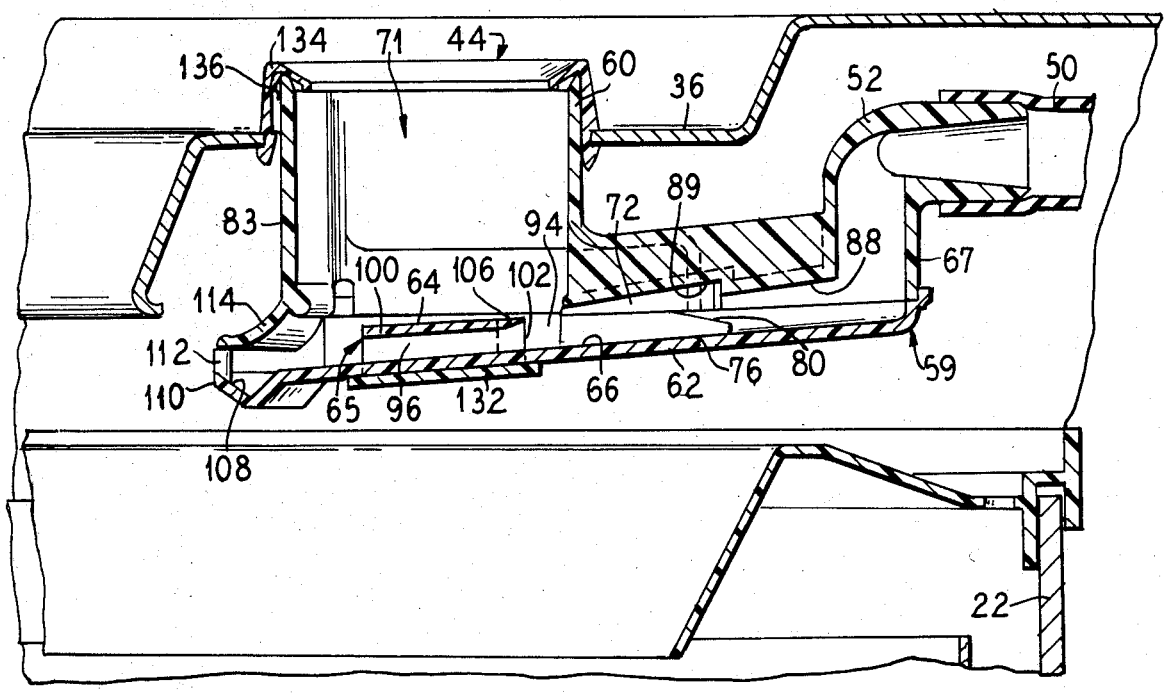
FIG. 6 is a side sectional view of the detergent dispenser taken generally along line VI—VI of FIG. 4.

The dispenser itself comprises a housing 59 and is formed in three separate pieces as best seen in FIG. 6. A top piece 60 and a bottom piece 62 are formed separately of a plastic material such as polystyrene and are secured to one another by appropriate fastening means such as adhesives or plastic welding techniques. The third piece comprises a chute cover 64, which is attached to a wall 66 of the bottom piece 62 which forms the bottom wall of the housing 59. The chute cover 64 can also be formed of polystyrene and can be attached as described with respect to the upper and lower pieces. The chute cover 64 and wall 66 cooperate to define a fluid tunnel, or chute 65 for the incoming water.

The passage 58 is formed at a first end 67 of the housing 59 between the top piece 60 and bottom piece 62 and flares outwardly away from the vertical portion 56 of the inlet tube 52 as shown at wall portions 68, 70 toward a reservoir portion 71 of the housing 59. As the liquid moves through passage 58 toward the reservoir portion 71, most of the liquid is directed by a pair of right and left guides 72, 74 formed on the top piece 60 which overlie and align with a second pair of right and left guides 76, 78 formed on the bottom piece 62 of the housing, toward the chute cover 64.

A portion of the incoming liquid will pass to the right of the guide 72 and its associated guide 76 along the flared out wall portion 68 to bypass the chute cover 64 (FIG. 5). A deflector 79 formed on the bottom piece 62 ensures that at least a portion of this liquid stream will follow the side contour of the dispenser housing. To provide an additional amount of liquid along this flow path, the guide 76 has a slight taper 80 at the entrance end thus providing a slight gap between the lower guide 76 and the upper guide 72 (FIG. 6).

Similarly, a portion of the liquid stream coming from the inlet 52 passes to the left of the guides 74, 78 and along the flared wall portion 70 of the housing (FIG. 5).

The reservoir portion 71 of the housing 59 is formed by the bottom wall 66 of the bottom piece and surrounding open topped side walls 81, 82 and 83 formed in a generally triangular configuration, slightly inset from the outer periphery of the bottom wall 66. The wall 81 is positioned towards the first end 67 of the housing 59 substantially at right angles to the passage 58 and extends both to the right and left of the passage. To the left it connects with wall 82 at a curved portion 84. The wall portion 82 extends farther from the curved junction 84 than does wall 81 and both walls connect to wall 83 at curved portions 85, 86. The top piece forming the side walls of the reservoir 71 and the bottom piece forming the bottom wall are sealed substantially along the entire length of walls 81 and 82.

Since the left side of the housing comprises a greater area than the right side, the left guides 74, 78 are shorter than the right guides 72, 76, thus providing a greater space between the end of the left guides 74, 78 and the flared wall 70. Also, the lower guide 78 is tapered at 87 to an even greater extent than the taper 80 of lower guide 76. Thus, an increased flow along the left side of the housing is assured.

Further, the top piece 60 of the housing 59 has a ceiling wall portion 88 which forms the top of passage 58 and which is stepped upwardly at 89 to increase the volume of the passage 58 (FIG. 6). The right guides 72, 76 extend to contact with the ceiling surface 88, however the left guides 74, 78 stop short of the ceiling surface 88 and terminate in the step portion 89 and provide additional area for liquid to flow along the left side of the housing (FIG. 4).

The liquid that is directed between the guides 72, 74 and 76, 78 is directed toward the chute cover 64. However, the ends of the guides 72, 74 and 76, 78 are flared outwardly and terminate a distance away from the entrance to the chute 65. Thus, there is a right lateral space 90, a left lateral space 92 and a top space 94 for some of the liquid to again bypass the chute 65. However, a substantial amount of the liquid will be directed into the chute. The chute cover 64, which functions as a tunnel, comprises two side walls 96, 98 and a top wall 100. An end 102 of the side wall 96 and an end 104 of the side wall 98 which are both closest to the guides 72, 74, 76 and 78 are tapered to provide a clean, sharp entrance to the chute to reduce turbulence of the water flow entering the chute. The taper is to the outside of the walls, thus increasing the flow path area for the liquid which bypasses the chute laterally.

The top wall 100 has a front edge 106 which is tapered, with the taper to the interior of the chute (FIG. 6). The taper again provides for a reduction in the turbulence of the liquid entering the chute and, being on the interior of the chute, increases the velocity of the liquid traveling through the chute.

Along the length of wall 83, the bottom piece 62 has formed therein a channel 108 which is depressed below the level of the bottom wall 66 and has a front lip edge 110. A post 112 is provided approximately midway along the length of the lip 110 between opposite ends of the channel to provide a supporting connection between the upper and lower pieces 60, 62 of the housing 59. The upper piece 60 has an outwardly flared lip portion 114 extending the length of wall 83 above the channel 108 and spaced above lip edge 110 to form a long, narrow discharge opening 116 for the dispenser 44.

The bottom wall 66 is sloped downwardly from the passage 58 to the opening 116 to assist in the complete dispensing of all of the detergent from the dispenser. The bottom wall 66 is also sloped to the right in an area 118 adjacent to the rounded corner 85 joining walls 81 and 83. This slope ensures that detergent will not accumulate in the corner adjacent to the discharge opening 116. The bottom wall 66 is also sloped toward an outer edge 120 which is spaced outboard from wall 82 such that a shallow channel 122 is formed along the left outside edge 120 of the bottom wall 66 to ensure that the entire left side of the bottom wall is flushed and that all of the detergent is thereby dispensed. A protruding spout 124 is formed at the junction of the left edge 120 of the bottom wall and the channel 108. The spout extends downwardly below the level of the remainder of the bottom wall to ensure that there is complete drainage from the dispenser.

The side walls 96, 98 of the chute cover 64 are received in slots 126, 128 formed in the bottom wall 62 for precise placement of the chute cover 64 relative to the guides 76, 78. Support members 130, 132 are attached to the bottom of the bottom wall 66 to assist in the attachment of the chute cover 64 to the bottom wall. The chute cover 64 is spaced away from the discharge outlet 116 so that when a charge of granular detergent or other additive is placed into the reservoir portion 71 at least the outlet end of the chute will be positioned beneath or within the pile of detergent such that liquid which is directed through this chute will emerge from the chute beneath the pile of detergent to assist in the dispersement thereof. It has been found that by delivering liquid to a point beneath the pile of detergent, the dispensing function is greatly enhanced.

The dispenser 44 along with dispensers 40 and 42 are held in place by a plastic bezel 134 which slips over and is held by a plurality of tabs 136 on the outer periphery of the dispenser walls 81, 82 and 83.

As seen in FIGS. 11–14, an insert 138 can be used which allows the dispenser to dispenser liquid additives. The insert 138 has a reservoir portion 140 for receiving the liquid additive. The reservoir 140 has a water inlet scoop 142 (FIG. 12) which is positionable within the dispenser 44 in the space 90, 92, 94 between the guides 72, 74, 76, 78 and the chute cover 64. A diverter member 144 has a right leg 146 which substantially blocks the area between the curved wall portion 68 of inlet passage 58 and the guides 72, 76 and a left leg 148 which substantially blocks off the space between the curved wall portion 70 and the guides 74, 78. The diverter 144 also has a front upstanding wall 150 which extends above the legs 146, 148 to block off the space above the guides. The front wall 150 is spaced above the bottom wall 66 of the granular dispenser to provide free access and communication between the inlet passage 58 and the inlet scoop 142. Thus, virtually all of the liquid flowing in through inlet 58 is directed into inlet scoop 142.

As the water enters inlet 142 it passes through a vertical chamber 152 where it flows over a top wall 154 into a vertical space 156 between the vertical chamber 152 and a measuring and diverting insert 158. The vertical chamber 152 is defined by three upstanding walls 160, 162 and 164 joined in a triangular relationship. The inlet scoop 142 communicates with the vertical chamber 152 directly below the inlet chamber wall 160. The measuring insert 158 has three triangularly arranged walls 166, 168 and 170 which surround the triangularly arranged walls 160, 162, 164 of the inlet chamber 162 and are held in a precise position by spacing tabs 172, 174, 176 formed on the exterior of the vertical chamber walls 160, 162, 164 near the three vertex junctions of those walls. The three triangular walls 160, 162, 164 are joined together by a top wall 178. The measuring insert 158 is further positioned by means of a button 180 formed at the top of wall 166 which engages in an opening 182 in the reservoir wall 141.

The bottom of wall 168 has a lateral foot 184 extending therefrom which has a passage 186 communicating beneath the wall 168 to the space 156 between the two sets of triangular walls. Thus, water which has flowed over the top 154 of vertical chamber 152 will flow out through the passage 186 in the foot 184 to the interior of the reservoir 140. Extending laterally outwardly from the wall 170 is a stepped wall 188 having a first horizontal step 190, a second horizontal step 192 and a horizontal top 194. Indicia markings can be placed on the horizontal steps 190, 192 to provide a measuring function so that the user will be apprised of the amount of liquid additive being supplied to the reservoir 140 prior to initiation of the washing steps. The number of steps can be changed to provide for differing measurement, if desired.

As inlet liquid fills the reservoir 140 and mixes with the liquid detergent, the detergent will become diluted and the liquid level within the reservoir will rise until it reaches the level of a plurality of openings 196 which are spaced around the perimeter of the reservoir wall 141. The level of the openings 196 is slightly above the level of the vertical chamber top wall 154 so that after the termination of the introduction of inlet liquid to the inlet scoop 142, the level of liquid within the reservoir 140 will be above the level of wall 154. At this point, the entire vertical chamber 152 will be filled with liquid as will the space 158 between the triangular walls. As the liquid begins to move downwardly in vertical chamber 152 under the influence of gravity, a siphoning effect will cause all of the liquid within the reservoir to enter through passage 186, up through the space 156 between the triangular walls and down through the vertical chamber 152 and out through either lateral side of the scoop 142 to drain out through the dispenser 44 through the channel 108 and opening 116. In this manner, all of the liquid detergent will be diluted and dispensed into the washer and the dispenser and insert reservoir 140 will be left in a virtually empty condition.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. In an automatic fabric washing apparatus having means defining a fabric treatment zone, an improved wash additive dispenser comprising:

a wash additive reservoir having means defining a liquid inlet, a liquid outlet, and a space for receiving a single mass of wash additive to be dispensed;

liquid passage means disposed in fluid flow association with said liquid inlet means and arranged to deliver a first portion of the liquid discharged from said inlet to a region of contact with said additive underneath or within the single mass of wash additive contained in said reservoir and a remaining portion directly against an exterior surface of the mass of wash additive; and liquid supply means for supplying a quantity of washing liquid to said inlet means to effect the discharge of said liquid and said additive through said outlet means.

2. An additive dispenser of claim 1, wherein said liquid passage means includes a tunnel member for delivering at least a portion of the liquid from said inlet underneath or within said mass of wash additive.

3. An additive dispenser of claim 2, wherein said tunnel member is spaced from a point at which liquid is discharged into said reservoir such that some of said liquid flows over and around said tunnel member.

4. A granular additive dispenser for use in an automatic washer comprising:

a reservoir for receiving a single charge of granular wash additive;

said reservoir having a liquid inlet and a liquid outlet;

means formed in said reservoir for directing a first portion of the liquid from said liquid inlet to a point of contact with said additive beneath or within said single charge of additive and a remaining portion directly against an exterior surface of said single charge of additive;

whereby, said additive is dispensed through said liquid contact.

5. A dispenser according to claim 4, wherein said means comprises a liquid passage within said reservoir being at least partially covered so that said charge of additive will overlie said covered portion.

6. A granular additive dispenser for use in an automatic washer comprising:

a reservoir for receiving a single charge of granular additive;

said reservoir having a liquid inlet passage at one end and a narrow slot-like outlet opening at an opposite end;

an enclosure member positioned between said inlet passage and outlet opening for delivering a first portion of the liquid from said inlet passage to a region of contact with said additive beneath or within said single charge of additive in said reservoir and permitting a remaining portion to impinge directly against an exterior surface of said single charge of additive.

7. An additive dispenser according to claim 6, including a plurality of guide members to channel a portion of the inlet liquid toward said enclosure member and a portion around and above said enclosure member so that substantially the entire area within said reservoir will be flushed by said liquid.

8. An additive dispenser according to claim 7, wherein said reservoir further includes a bottom wall sloped downwardly from said inlet passage towards said outlet opening to assist in the complete flushing of said reservoir.

9. An additive dispenser according to claim 8, wherein said slot-like outlet opening includes a channel formed along its entire length to prevent premature dispensing of said granular additive.

10. A granular additive dispenser for use in an automatic washer comprising:

a reservoir for receiving a single charge of granular detergent;

a liquid inlet passage formed at one side of said reservoir;

a narrow slot-like outlet opening formed at an opposite side of said reservoir;

an enclosure member positioned between said inlet passage and outlet opening for delivering a portion of the liquid from said inlet passage to a region of contact with said additive beneath or within said single charge of detergent in said reservoir;

a plurality of guides within said inlet passage to direct a portion of said liquid towards said enclosure;

said enclosure being spaced from said guides such that a portion of said inlet liquid will flow over and around said enclosure member to allow said inlet liquid to impinge directly against an exterior surface of said single charge of additive.

11. An additive dispenser according to claim 10, wherein said reservoir further includes a bottom wall sloped downwardly from said inlet passage towards said outlet opening to assist in the complete flushing of said reservoir.

12. An additive dispenser according to claim 11, wherein said slot-like outlet opening includes a channel formed along its entire length to prevent premature dispensing of said granular additive.

13. An additive dispenser according to claim 10 wherein said reservoir further includes a bottom wall and side walls extending from said inlet opening to said outlet opening, and wherein said guides include means for directing a portion of the liquid from said inlet passage laterally along said bottom wall toward said side walls to thereby flush detergent from those portions of said bottom wall that are spaced from the region of said enclosure member.

14. An additive dispenser according to claim 10 including an insert container for receiving a charge of liquid additive which is insertable into said reservoir; said container having a liquid inlet opening positionable between said enclosure member and said inlet passage such that inlet liquid will be directed into said insert container; said container further having outlet openings for discharging said liquid and liquid additive.

* * * * *